US006288695B1

(12) United States Patent
Wood

(10) Patent No.: US 6,288,695 B1
(45) **Date of Patent: *Sep. 11, 2001**

(54) METHOD FOR DRIVING AN ADDRESSABLE MATRIX DISPLAY WITH LUMINESCENT PIXELS, AND DISPLAY APPARATUS USING THE METHOD

(76) Inventor: Lawson A. Wood, 873 N. Frederick St., Arlington, VA (US) 22205

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/139,757

(22) Filed: Aug. 25, 1998

Related U.S. Application Data

(63) Continuation of application No. 09/063,364, filed on Apr. 21, 1998, and a continuation of application No. 08/381,156, filed on Jan. 31, 1995, and a continuation of application No. 07/862,313, filed on Apr. 2, 1992, now abandoned, and a continuation of application No. 07/521,399, filed on May 10, 1990, now Pat. No. 5,128,782, and a continuation of application No. 07/396,916, filed on Aug. 22, 1989, now abandoned.

(51) Int. Cl.[7] ..... G09G 3/22

(52) U.S. Cl. ..... 345/75.2; 315/169.1; 313/309; 345/147

(58) Field of Search ..... 345/55, 60, 74, 345/75, 76, 87, 63, 204, 75.2, 74.1, 507, 147, 84; 348/797; 315/169.1, 169.3, 167; 313/336, 371, 495, 309

(56) References Cited

U.S. PATENT DOCUMENTS

| | | | | |
|---|---|---|---|---|
| 5,103,144 | | 4/1992 | Dunham . | |
| 5,122,791 | | 6/1992 | Gibbons et al. | 345/102 |
| 5,157,309 | | 10/1992 | Parker et al. . | |
| 5,196,839 | | 3/1993 | Johary et al. . | |
| 5,262,698 | | 11/1993 | Dunham . | |
| 5,317,334 | * | 5/1994 | Sano | 345/148 |
| 5,416,496 | | 5/1995 | Wood | 345/102 |
| 5,452,024 | | 9/1995 | Sampsell | 348/755 |
| 5,530,457 | * | 6/1996 | Helgeson | 345/185 |
| 5,578,906 | * | 11/1996 | Smith | 315/169.3 |
| 5,644,195 | | 7/1997 | Browning . | |
| 5,757,348 | | 5/1998 | Handschy et al. . | |
| 5,767,828 | * | 6/1998 | McKnight | 345/89 |
| 5,847,515 | * | 12/1998 | Lee et al. | 315/169.1 |
| 5,936,355 | * | 8/1999 | Kim | 315/169.4 |
| 5,936,597 | | 8/1999 | Hyun et al. . | |
| 5,945,968 | | 8/1999 | Hush . | |
| 6,184,854 | | 2/2001 | Hotto et al. | 345/89 |
| 6,184,874 | | 2/2001 | Smith et al. | 345/204 |

* cited by examiner

*Primary Examiner*—Richard Hjerpe
*Assistant Examiner*—Frances Nguyen
(74) *Attorney, Agent, or Firm*—Venable; Allen Wood

(57) ABSTRACT

A display apparatus employs a field emission display device with pixels which are turned on and off in accordance with different bits of video words that are being displayed. The field emission display device is driven so that its pixels emit light at different intensity levels, depending upon the rank of the bits that are being displayed.

12 Claims, 6 Drawing Sheets

METHOD FOR DRIVING AN ADDRESSABLE MATRIX DISPLAY WITH LUMINESCENT PIXELS, AND DISPLAY APPARATUS USING THE METHOD

CROSS-REFERENCE TO RELATED APPLICATIONS

This application is a continuation of application Ser. No. 09/063,364 filed on Apr. 21, 1998, and a continuation of application Ser. No. 08/381,156 filed on Jan. 31, 1995, and a continuation of application Ser. No. 07/862,313 filed on Apr. 2, 1992 abandoned and a continuation of application Ser. No. 07/521,399 filed on May 10, 1990 now U.S. Pat. No. 5,128,782, and a continuation application Ser. No. 07/396,916 filed Aug. 22, 1989 now abandoned.

The present patent application was filed during the pendency of Applicant's earlier applications Ser. No. 08/381,156 and Ser. No. 09/063,364, which were filed respectively on Jan. 31, 1995 and Apr. 21, 1998. Application Ser. No. 08/381,156 was filed during the pendency of Applicant's earlier application Ser. No. 08/034,694, which was filed on Mar. 19, 1993. That application was filed during the pendency of Applicant's earlier application Ser. No. 07/862,313, which was filed on Apr. 2, 1992. That application was filed during the pendency of Applicant's earlier application Ser. No. 07/521,399, which was filed on May 10, 1990. That application was filed during the pendency of Applicant's earlier application Ser. No. 07/396,916, which was filed on Aug. 22, 1989. The disclosures of these prior applications are incorporated herein by reference. Application Ser. No. 07/521,399 matured into U.S. Pat. 5,128,782, which issued on Jul. 7, 1992, and application Ser. No. 08/034,694 matured into U.S. Pat. 5,416,496, which issued on May 16, 1995. Application Ser. No. 07/396,916 and application Ser. No. 07/862,313 have been abandoned.

Although, at the time of filing the present application, Applicant does not claim the benefit under 35 U.S.C. § 120 of any of the chain of co-pending applications identified above, Applicant reserves the right to claim such benefit if, at any time during the pendency of the present application at the Patent and Trademark Office or thereafter, prior art is discovered which makes such a claim for the benefit of an earlier filing date desirable.

BACKGROUND OF THE INVENTION

The present invention is directed to a display apparatus with an addressable matrix display device of the type having pixels which are driven to produce light. In the present document, such a display device will be called an addressable matrix display device with luminescent pixels. Such display devices are to be distinguished from display devices which employ luminescent pixels but not an addressable matrix, such as cathode ray tubes. Such display devices are also to be distinguished from display devices which employ an addressable matrix of light valves to modulate light from a source that illuminates the light valves. Examples here include liquid crystal display devices and digital micromirror devices.

Several families of addressable matrix display devices with luminescent pixels have been proposed. These include LED arrays, plasma display panels, electroluminescent panels, and field-emission display devices. In each case, the display device has an addressable matrix of light-generating means.

A summary of the current (1998) state of the art in field-emissions display devices was presented in an article by Babu R. Chalamala et al, "Fed Up With Fat Tubes," at pages 42–51 of the April 1998 issue of *IEEE Spectrum*. An example of a conventional field-emission display device 10 is shown in FIG. 1. It includes a base plate 12 which supports a number of parallel cathode electrodes 14 (only a few of which are shown). A number of parallel gate electrodes 16 (only a few of which are shown) cross the cathode electrodes 14 and are spaced apart from them by a small gap. The gate electrodes 16 have holes 18 to permit passage of electrons. Red phosphor stripes 20, green phosphor stripes 22, and blue phosphor stripes 24 are deposited on a transparent anode electrode 26 made, for example, from ITO. The assembly is disposed in a vacuum envelope (not shown).

The cathode electrodes 14 emit electrons when a suitable potential is applied between the cathode electrodes 14 and the gate electrodes 16. Unlike the emission process in a cathode ray tube, which employs a heater, the cathode electrodes 14 are cold cathodes which are stimulated to emit electrons when a strong electric field is present. Several approaches are known which provide good cathode electrodes. In FIG. 1, so-called Spindt tips 28 are included in the cathode electrodes 14, and project upward at the locations of the holes 18 to provide enhanced electron emissions. Typically, a plurality of Spindt tips are employed in each pixel. For example, in FIG. 1, the red pixel 30 is shown as having four Spindt tips 18 which cooperate with four holes 28 to generate current for illuminating the adjacent portion of red phosphor stripe 20. A green pixel and a blue pixel are provided adjacent the pixel 30, along the same gate electrodes 16, to form a three-pixel group having all three primary colors.

There is minimal electron emission from the cathode electrodes until they are exposed to an electric field that is higher than a threshold value. When the field strength is higher than the threshold, the number of electrodes emitted per unit of time (that is, the current) increases as the strength of the electric field increases. FIG. 2 illustrates a typical example, with the horizontal axis representing the voltage between a cathode electrode 14 and a gate electrode 16 (which are closely spaced, so that a potential between them of only 45 volts is sufficient to produce an electric field that is larger than the threshold) and the vertical axis represents current in microamperes.

The electrons emitted by the cathode electrodes 14 under the influence of the gate electrodes 16 are accelerated toward the phosphor stripes 20–24 by a positive voltage that is placed on the anode 26. The higher the anode voltage, the greater the acceleration and, for a given cathode current, the brighter the light produced by the phosphors. The phosphors also glow more brightly when the cathode current is increased. However, increasing the cathode current does not appreciably increase the brightness of the phosphor glow after the current reaches a so-called current saturation level. Furthermore, too high a cathode current degrades the phosphors.

Among other addressable matrix-type display devices that are known are display devices which employ an array of light valves to spatially modulate light that shines on the array. The light valves may have variable optical densities or attenuations properties that are electrically controlled so as to determine the percentage of the impinging light that passes through each light valve. An example is a twisted nematic liquid crystal display device. Other spatial light modulators employ bi-stable light valves, meaning that they are either on or off. Examples here include digital micromirror devices and ferroelectric liquid crystal display devices. Since the light valves are bi-stable, rather than having continuously variable attenuation, special measures must be taken in order to provide a gray scale in a display apparatus which includes such a display device. For a display apparatus with a digital micro-mirror device, a gray scale can be achieved by using a pulse width modulation scheme in which the length of time in which the micro-mirrors are in their ON position is controlled, as is explained in U.S. Pat. No. 5,452,024 and in an article entitled "Mirrors on a Chip" that was published in the November 1993 edition of *IEEE Spectrum* at pages 27–31 by Jack M. Younse. For a display apparatus with a ferroelectric display device, a gray scale can be achieved by controlling the intensity or duration of the back-lighting on the basis of the rank or significance of the bits that are being displayed, as is disclosed in U.S. Pat. Nos. 5,122,791 and 5,416,496. Controlling the intensity of the impinging light on the basis of the rank of the displayed bits can also be used in a display apparatus with a digital micro-mirror device to control the level of gray that is displayed at each pixel, as is explained in Applicant's co-pending applications Ser. Nos. 08/381,156 and 09/063,364, filed respectively on Jan. 31, 1995 and Apr. 21, 1998.

SUMMARY OF THE INVENTION

An object of the invention is to provide an improved method for displaying an image on an addressable matrix display device having luminescent pixels.

A related object is to reduce the time needed to display an image by exciting the luminescent pixels to different degrees so that they emit light at different intensity levels as the image is being displayed. Different bit ranks of video words which specify the image may also be displayed for different time periods.

The above objects can be attained, when the addressable matrix display device is a field emission display device, by placing signals corresponding to bits of video words on the cathode electrodes of the field emission display device while strobing the gate electrodes of the field emission display device with a gate voltage and applying an anode voltage to the anode electrode of the field emission display device. At least one of the anode and gate voltages is changed while this occurs so that the phosphor stripes of the field emission display device emit light at different intensity levels, depending upon the bit rank of the video words that are being displayed.

DESCRIPTION OF THE PREFERRED EMBODIMENTS

Figure 3:
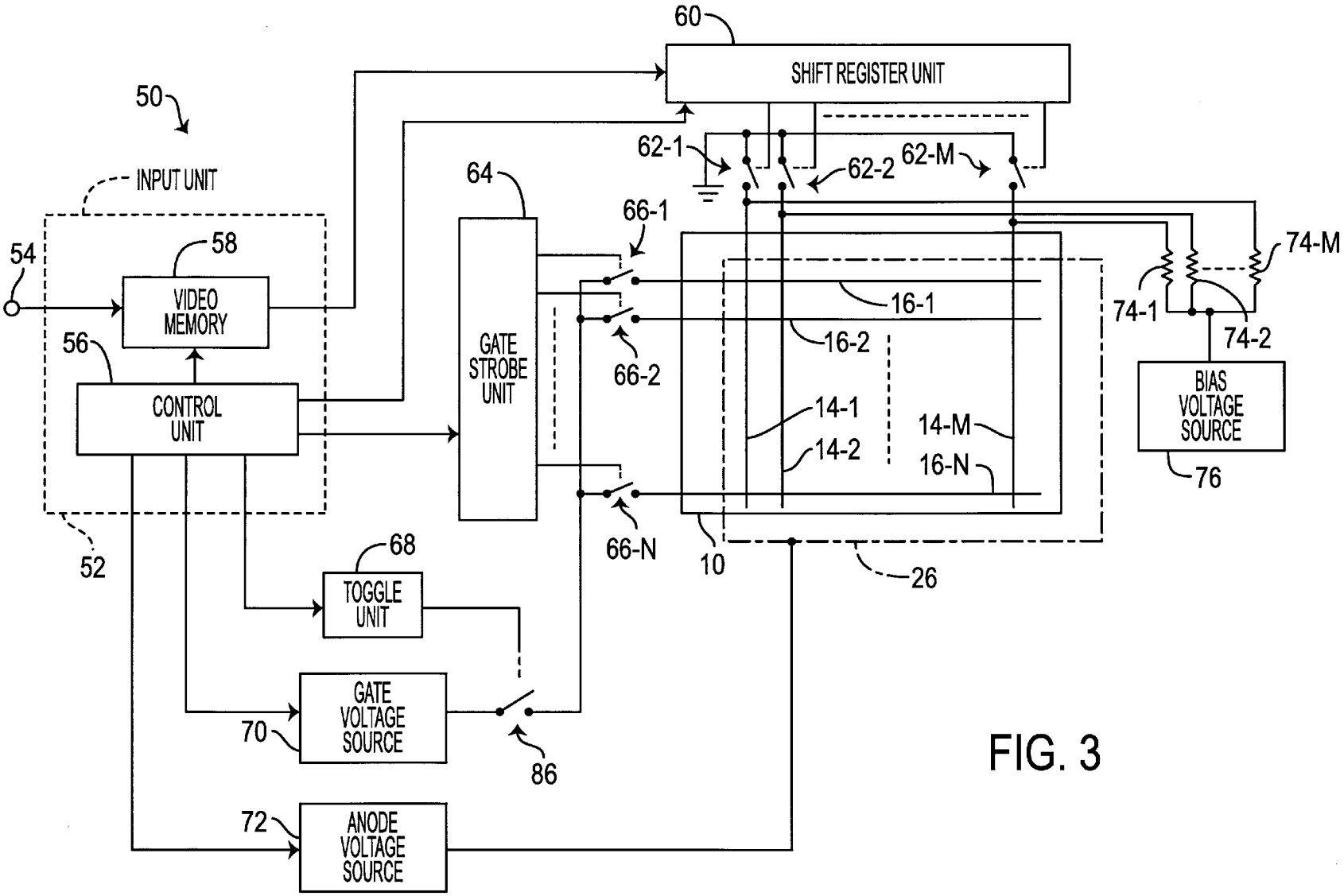
FIG. 3 is a block diagram illustrating an embodiment of a display apparatus which employs the method of the present invention.

A display apparatus 50 in accordance with the present invention is shown in FIG. 3, and includes an input unit 52 having an input port 54 which receives digitized signals for an image. In what follows, these digitized signals will be said to consist of red video words for the red component of the image, green video words for the green component, and blue video words for the blue component. The input unit 52 includes a control unit 56 which reads the incoming video words into a video memory 58, which stores a frame of red, green, and blue video words.

Figure 1:
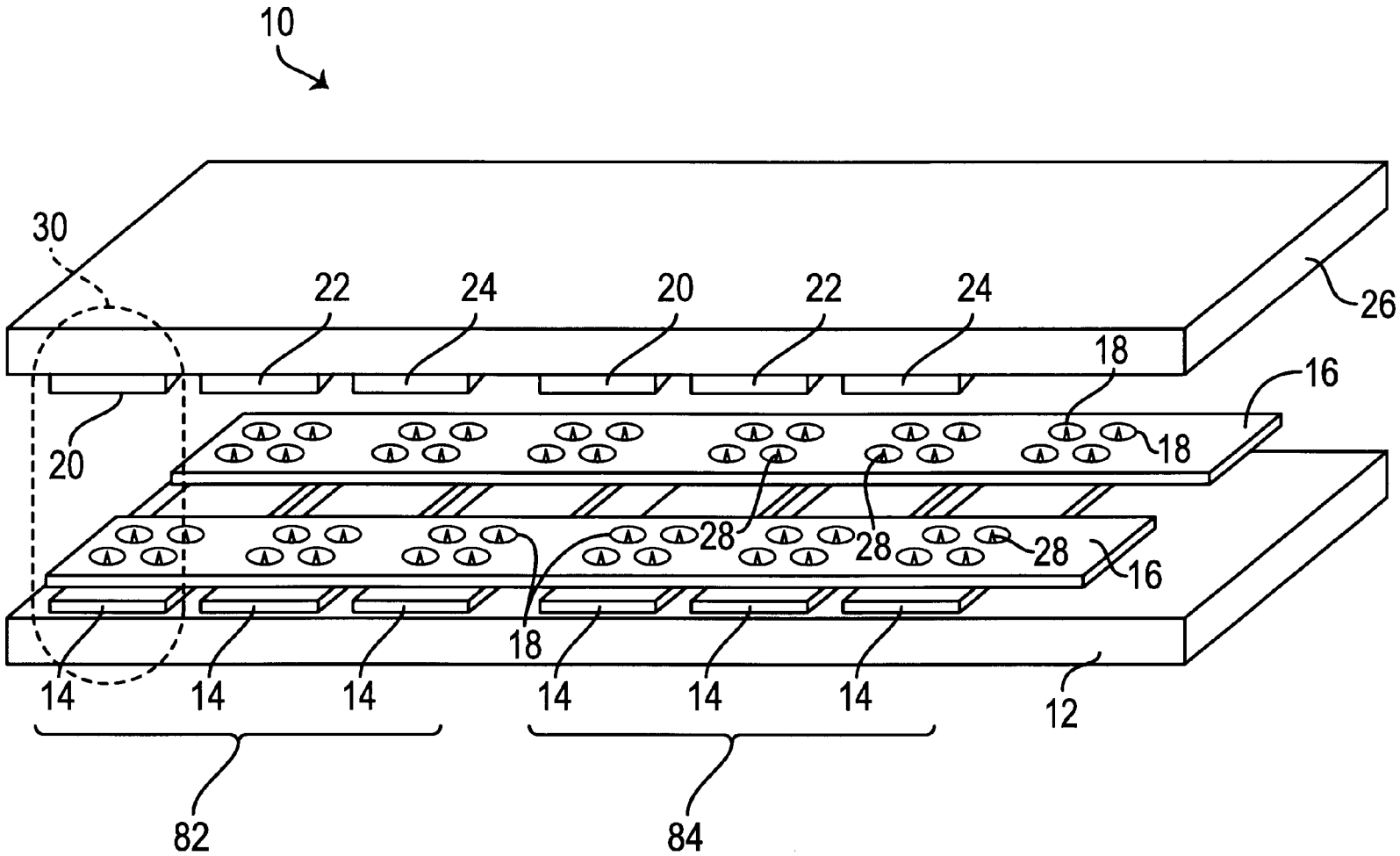
FIG. 1 (PRIOR ART)
FIG. 1 is an exploded perspective view illustrating a portion of a field emission display device.

The apparatus 50 also includes a field emission display device 10, which was previously described with reference to FIG. 1. The display device 10 includes M cathode electrodes 14 (only three of which, identified by reference numbers 14-1, 14-2, and 14-M, are shown) and N gate electrodes 16 (only three of which, identified by reference numbers 16-1, 16-2, and 16-N, are shown).

The display apparatus 50 additionally includes a shift register and driver unit 60 having M stages. Each of these stages is connected to an electrically-controlled cathode switch 62 (only three of which, identified by reference numbers 62-1, 62-2, and 62-M, are shown). A gate strobe unit 64 has N outputs that are connected, respectively, to N gate switches 66 (only three of which, identified by reference numbers 66-1, 66-2, and 66-N, are shown). A toggle unit 68, a gate voltage source 70, and an anode voltage source 72 receive signals from control unit 56. The M cathode electrodes 14 are connected by M pull-up resistors 74 (only three of which, identified by reference numbers 74-1, 74-2, and 74-M, are shown) to a positive bias voltage source 76.

Figure 4:
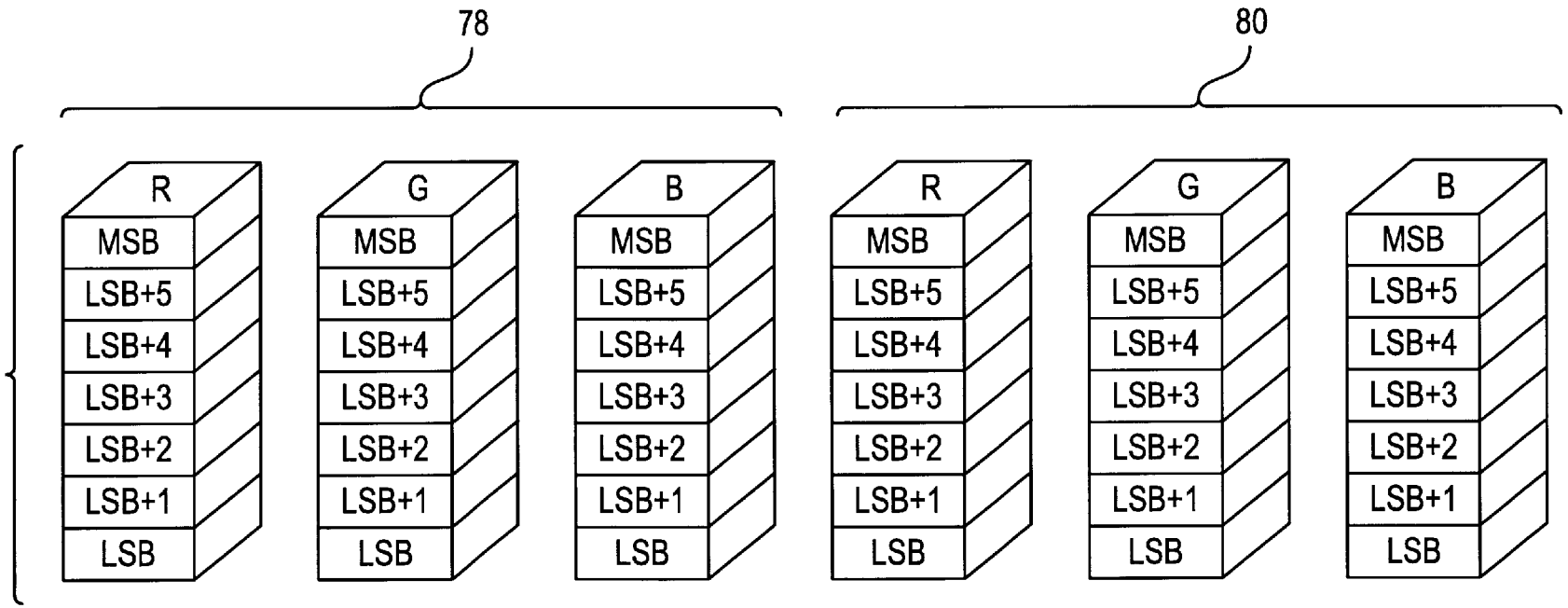
FIG. 4 schematically illustrates the format of video words which specify an image that is to be displayed by the display apparatus.

FIG. 4 schematically illustrates two groups of red, green, and blue video words in a row. It will be assumed in what follows that each of these video words has seven bits, ranging from a least significant bit (LSB) to a most significant bit (MSB). As will be described in more detail below, the least significant bits are displayed, row-by-row, for the entire image, and then the LSB+1 bits are displayed, row-by-row, for the entire image, and so on. For example, to display the six video words shown in FIG. 4 at the six pixels shown in the front row in FIG. 1, signals corresponding to the LSB bits of the word group 78 would be placed on the group 82 of cathode electrodes 14, signals corresponding to the LSB bits of the word group 80 would be placed on the group 84 of cathode electrodes 14, and the front gate electrode 16 would be strobed. As a result, dots of the appropriate colors at the relevant pixel locations where the LSB bits have a value of 1, and not at pixel locations where the LSB bits have a value of 0, will be displayed. After the LSB bits in other rows have been displayed, signals corresponding to the LSB+1 bits of word group 78 would be placed on group 82 of cathode electrodes 14, signals corresponding to the LSB+1 bits of word group 80 would be placed on group 84 of cathode electrodes 14, and the front gate electrode 16 would be strobed again. This process would continue, bit rank by bit rank of the video words, until the most significant bits have been displayed.

Returning now to FIG. 3, the operation of display apparatus 50 will be described in more detail. Control unit 56 reads the least significant bits of the red, green, and blue video words for the top row of the image into the shift register and driver unit 60. While this occurs, the toggle unit 68 holds an isolation switch 86 open. After the least significant bits of the top row have been read into shift register unit 60, the cathode switches 62 have either an open state or a closed state, depending upon the values of the least significant bits. For example, if the least significant bit stored in the left-most stage of shift register has a value of 1, switch 62-1 would be closed and, consequently, cathode electrode 14-1 would be connected to ground. If the next left-most stage stored a value of 0, switch 62-2 would be open and, consequently, cathode electrode 14-2 would carry a positive bias voltage supplied by source 76.

After the top row of least significant bits has been loaded into the shift register unit 60, the control unit 56 signals toggle unit 68 to close the isolation switch 86. Control unit 56 then signals the strobe unit 64 to close the gate switch 66-1 for the top row. As a result, the gate voltage source 70 is connected to the top gate electrode 16-1 via the switches 86 and 66-1.

Control unit 86 then signals toggle unit 86 to open isolation switch 86 and reads the least significant bits for the next row of the image from video memory 58 into the shift register unit 60. Toggle unit 68 then closes isolation switch 86 and gate strobe unit 64 closes gate switch 66-2. This process continues until the least significant bits for the bottom row of the image are loaded into shift register unit 60, and the gate strobe unit 64 closes the last gate switch 66-N. Then the process starts again, but this time the control unit 56 reads the LSB+1 bits into the shift register unit 60. The next time around, it is the LSB+2 bits, and so on until the MSB bits are displayed row-by-row for the entire image. Then the procedure begins again in order to display the next frame.

The control unit 56 emits a digital signal to the gate voltage source 70 to set a positive voltage that is applied to the gate electrodes 16. The gate voltage source 70 thus controls the cathode current that is emitted by those of the cathode electrodes 14 that are grounded (those of the cathode electrodes 14 that are not grounded carry a positive bias supplied by source 76 and do not emit a cathode current). Similarly, the control unit 56 emits a digital signal to anode voltage source 72, which applies a corresponding positive voltage to the anode 26. The gate voltage source 70 and the anode voltage source 72 jointly determine the brightness of the dots that are displayed at the pixel locations. In the present invention, the brightness is controlled in accordance with which bit rank of the video words is being displayed. One example is shown in FIG. 5.

Figure 5:
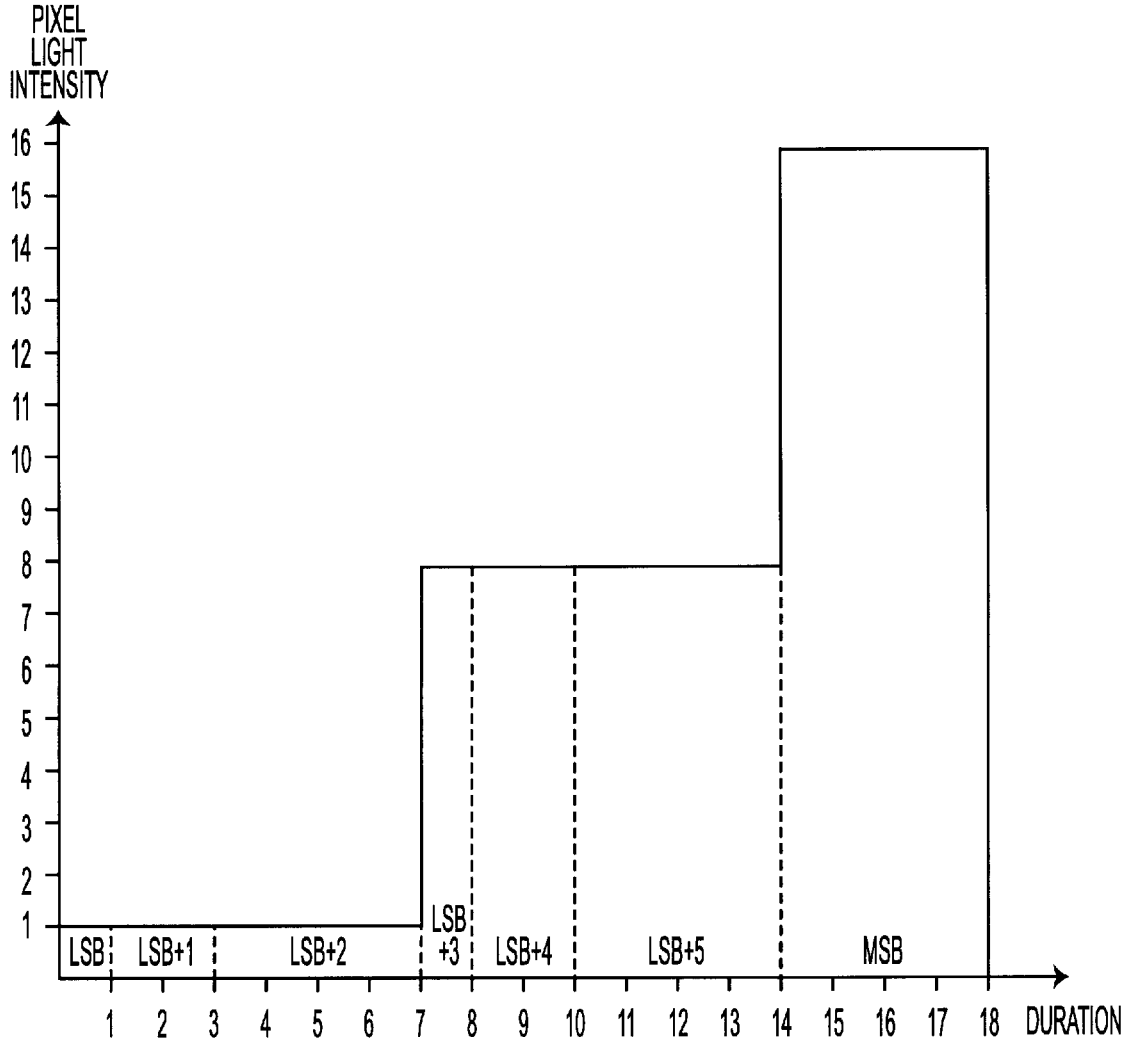
FIG. 5 is a graph schematically illustrating an example of different light intensity levels and different time periods while different bit ranks of the video words are being displayed.

FIG. 5 schematically illustrates the display of a frame. The horizontal axis indicates duration in arbitrary units of time, and the vertical axis indicates the light intensity at the pixel locations that are on, again in arbitrary units. During the display of the least significant bits, as rows of least significant bits are loaded into shift register 60 and the gate strobe unit 64 sequentially closes the gate switches 66, control unit 56 sets the gate voltage source 70 and the anode voltage source 72 so that the light intensity for pixels that are on (i.e., the least significant bit has a value of 1) has a light intensity level of 1 unit. The control unit 56 sets the strobe rate of unit 64 so that the duration of the display for the least significant bits is 1 time unit.

During the display of the LSB+1 bits, the gate voltage and anode voltage remain the same, but gate strobe unit closes the gate switches 66 for twice as long. As a result, the pixels that are on during the display of the LSB+1 bits emit twice the amount of light that on pixels emitted during display of the least significant bits. During display of the LSB+2 bits, the gate voltage and anode voltage still remain unchanged, but the gate strobe unit 64 doubles the closure time of the gate switches 66 again. As a result, the pixels that are one emit four times as much light.

If this process were to continue throughout all of the bits of the video words, then the display time would become excessive. Instead, during display of the LSB+3 bits, control unit 56 signals anode voltage source 72 to increase the positive voltage that is applied to anode 26. The increased anode voltage, coupled with the old gate voltage, raises the intensity of the pixels that are on. As is shown in FIG. 5, this raised intensity is set to be eight times the prior intensity, so that the LSB+3 bits can be displayed during one unit of time. The LSB+4 bits are displayed at the increased intensity during two units of time, and the LSB+5 bits are displayed at the increased intensity during four units of time. If the MSB bits were displayed at the same intensity, eight units of time would be needed.

Instead, during display of the MSB bits, the control unit 56 keeps the anode voltage unchanged, but signals the gate voltage source 70 to increase the positive gate voltage, and thus also the cathode current. In order to avoid excessive cathode current and consequent degradation of the phosphors, the gate voltage is selected so that the intensity is only twice what it was during display of the bits LSB+3 through LSB+5. The most significant bits can thus be displayed during four units of time.

Figure 2:
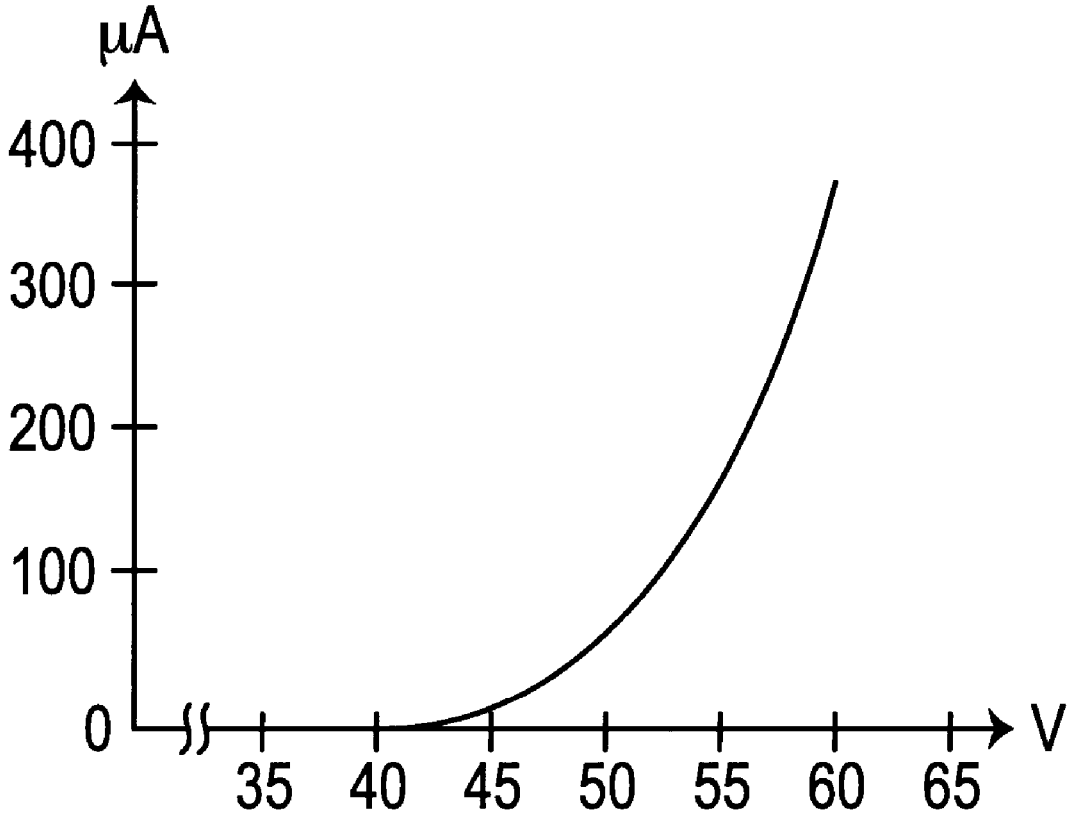
FIG. 2 is a graph illustrating a typical example of the relationship between cathode current and gate electrode voltage in a field emission display device.

The magnitude of the positive bias voltage that is supplied by source 76 is selected so that the highest gate voltage does not result in cathode current from cathode electrodes 14 that are connected to open cathode switches 62. For the example shown in FIG. 2, a bias voltage of about +40 v would permit the gate voltage to be raised to about +80 v without turning on pixels that are supposed to be off (although +80 v might result in an excessive cathode current). The point to be made is that the provision of a suitable positive bias voltage permits a relatively wide range of gate voltages and thus allows the cathode current to be set within a wide range.

For the sake of convenient illustration and discussion, FIG. 5 has been simplified by omitting the intensity drops that occur when the isolation switch 86 is opened during strobing of the gate electrodes 16. Nevertheless, FIG. 5 illustrates a fundamental feature of the present invention, which is that the light intensity is controlled in accordance with the rank or significance of the bits of the video words that are being displayed. It will be apparent that increasing the pixel intensity during display of a frame decreases the amount of time needed for the frame. The intensity can be controlled by setting the gate and anode voltages, and the total amount of light emitted at pixel locations that are on during display of any particular bit rank of the video words depends jointly on the light intensity and the duration.

Figure 6:
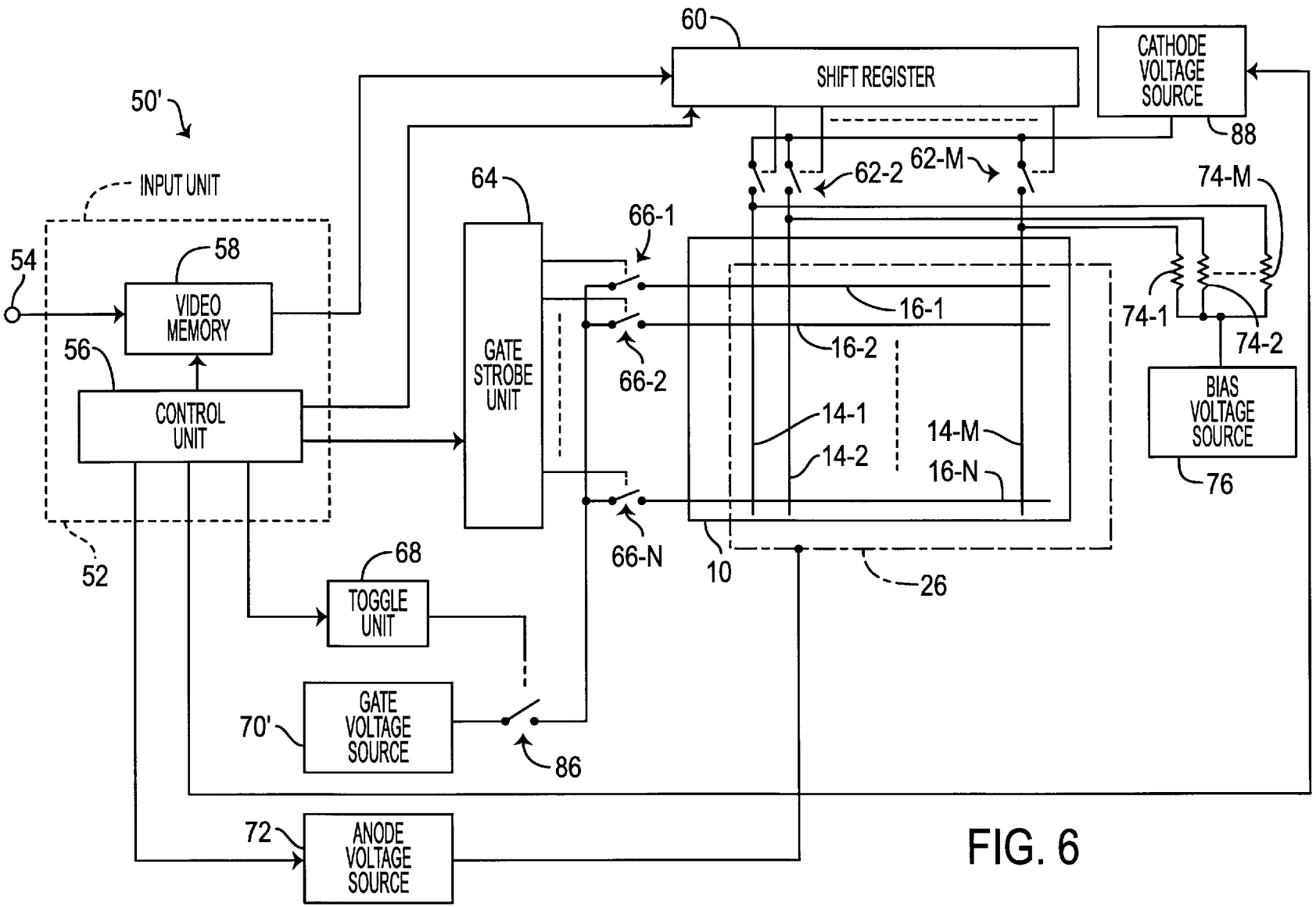
FIG. 6 is a block diagram illustrating a modification of the display apparatus shown in FIG. 3.

FIG. 6 illustrates a modified display apparatus 50' in which the cathode current is not adjusted by varying the gate voltage. Instead, the gate voltage source 70' is set at a fixed positive value, and the cathode current is adjusted by control unit 56 using a cathode voltage source 88 that is connected to the cathode switches 62.

It will be apparent to those ordinarily skilled in the art that the above description illustrates specific embodiments of the invention, but that many modifications are possible. The video words need not have seven bits, but may have more than seven to improve the gray scale, or less than seven if a coarser gray scale is acceptable. Furthermore, the display need not proceed from least significant bits to LSB+1 bits to LSB+2 bits, and so on to the MSB bits. The order in which the bit ranks are displayed is arbitrary. The LSB+3 bits of a frame could be displayed first, for example, followed by the MSB bits, followed by the LSB+2 bits, and then the other bit ranks.

Nor is it necessary that the specific light intensity profile shown in FIG. 5 be followed. FIG. 5 shows only three light levels, each having an intensity corresponding to a power of 2, but additional light intensity levels could be used in order to reduce the display time. For example, if the light intensity were increased to 2 units during display of the LSB+1 bits, one time period would be saved, and if the light intensity were to be increased to 4 units during display of the LSB+2 bits, three additional time periods would be saved. It is desirable, however, to avoid an excessive cathode current during display of the higher-order bits, particularly the MSB bits, since excessive cathode current degrades the phosphors. Excessive cathode current can be avoided (if necessary) by increasing the display time for the MSB bits, and possibly also for other high-ranking bits.

Although not shown, it would be possible to isolate the top or bottom row of pixels or the left or right column, and to display the image on the remaining portions of the display 10. The isolated row or column could then be used in conjunction with light sensors to measure the light intensity while supplying known signals to the isolated row or column. The gate and/or anode voltage and/or the display time could be incremented or decremented in accordance with the measurements to accommodate variations due to manufacturing tolerances or aging. Using such a measurement and adjusting scheme would permit the light intensity and display time to be adjusted so as to provide accurate binary levels.

It will be understood that the above description of the present invention is susceptible to various other modifications, changes, and adaptations, and the same are intended to be comprehended within the meaning and range of equivalents of the appended claims.

What I claim is:

1. A method for displaying an image on an addressable matrix, field emission display device having gate electrodes and having luminescent pixels at an anode electrode, the image being specified by video words having least significant bits and most significant bits, comprising:

(a) associating the pixels of the display device with corresponding video words;

(b) selecting pixels of the display device that are to be illuminated using the least significant bits of the corresponding the video words;

(c) exciting the pixels selected during step (b) so that they glow at a first light intensity level;

(d) selecting pixels of the display device that are to be illuminated using the most significant bits of the corresponding video words; and (e) exciting the pixels selected during step (d) so that they glow at a second light intensity level that is higher than the first light intensity level, wherein step (e) comprises changing an anode voltage that is applied to the anode electrode.

2. The method of claim 1, wherein steps (b) and (c) are conducted at a faster rate than steps (d) and (e).

3. The method of claim 2, wherein the video words additionally have LSB+X intermediate bits with bit ranks between the LSB bits and the MSB bits, X being an integer, and wherein the method further comprises steps (f) selecting pixels of the display device that are to be illuminated using the LSB+X intermediate bits of the corresponding video words, and (g) exciting the pixels selected during step (f) so that they glow at a third light intensity level that is between the first and second light intensity levels.

4. The method of claim 3, wherein steps (f) and (g) are conducted at a rate that is different from steps (b) and (c) and also different from steps (d) and (e).

5. The method of claim 1, wherein the second light intensity level is about a power of two times larger than the first light intensity level.

6. The method of claim 1, wherein step (e) further comprises also changing the gate voltage.

7. A method for displaying an image on a field emission display device having an anode electrode, gate electrodes, and cathode electrodes, the gate electrodes and cathode electrodes of the display device crossing at pixel locations of the display device, the image being specified by video words having least significant bits and most significant bits, comprising:

(a) associating the pixel locations of the display device with corresponding video words;

(b) using the least significant bits of the video words to select cathode electrodes at pixel locations corresponding to the video words;

(c) applying an anode voltage to the anode electrode, strobing the gate electrodes, and establishing a predetermined potential difference between the cathode electrodes selected in step (b) and the strobed gate electrodes;

(d) using the most significant bits of the video words to again select cathode electrodes at pixel locations corresponding to the video words; and (e) applying an anode voltage to the anode electrode, strobing the gate electrodes, and establishing a predetermined potential difference between the cathode electrodes selected in step (d) and the strobed gate electrodes, wherein both of the anode voltage and the potential difference employed in step (e) are different from the anode voltage and the potential different employed in step (c).

8. The method of claim 7, wherein steps (b) and (c) are conducted at a faster rate than steps (d) and (e).

9. A method for displaying an image on an addressable matrix display device having luminescent pixels, the image being specified by video words having least significant bits and most significant bits, comprising:

(a) associating the pixels of the display device with corresponding video words;

(b) selecting pixels of the display device that are to be illuminated using the least significant bits of the corresponding the video words;

(c) exciting the pixels selected during step (a) so that they glow at a first light level;

(d) selecting pixels of the display device that are to be illuminated using the most significant bits of the corresponding video words; and (c) exciting the pixels selected during step (d) so that they glow at a second light intensity level that is higher than the first light intensity level, wherein steps (b) and (c) arc conducted at a faster rate than steps (d) and (e).

10. The method of claim 9, wherein the display device is a field emission display device having an anode electrode and cathode electrodes, wherein step (c) comprises applying a predetermined cathode voltage on selected cathode electrodes and applying a predetermined anode voltage on the anode electrode, and wherein step (e) comprises changing at least one of the cathode and anode voltages.

11. The method of claim 10, wherein step (e) comprises changing both the cathode and anode voltages.

12. A method for displaying an image on a field emission display device having an anode electrode, gate electrodes, and cathode electrodes, the gate electrodes and cathode electrodes of the display device crossing at pixel locations of the display device, the image being specified by video words having least significant bits and most significant bits, comprising:

(a) associating the pixel locations of the display device with corresponding video words;

(b) using the least significant bits of the video words to select cathode electrodes at pixel locations corresponding to the video words;

(c) applying an anode voltage to the anode electrode, strobing the gate electrodes, and establishing a predetermined potential difference between the cathode electrodes selected in step (b) and the strobed gate electrodes;

(d) using the most significant bits of the video words to again select cathode electrodes at pixel locations corresponding to the video words; and (e) applying an anode voltage to the anode electrode, strobing the gate electrodes, and establishing a predetermined potential difference between the cathode electrodes selected in step (d) and the strobed gate electrodes, wherein at least one of the anode voltage and the potential difference employed in step (e) is different from the anode voltage and the potential different employed in step (c), and wherein steps (b) and (c) are conducted at a faster rate than steps (d) and (e).

* * * * *

UNITED STATES PATENT AND TRADEMARK OFFICE

CERTIFICATE OF CORRECTION

PATENT NO. : 6,288,695 B1
DATED : September 11, 2001
INVENTOR(S) : Lawson A. Wood It is certified that error appears in the above-identified patent and that said Letters Patent is hereby corrected as shown below:

Title page,
Item [63], Related U.S. Application Data, should be deleted.

Column 1,
The paragraph at lines 8-15, should be deleted.

Signed and Sealed this

Twelfth Day of November, 2002

*Attest:*

*Attesting Officer*

JAMES E. ROGAN
*Director of the United States Patent and Trademark Office*